US005988320A

United States Patent [19]

Mittermayr

[11] Patent Number: 5,988,320

[45] Date of Patent: Nov. 23, 1999

[54] ARRANGEMENT IN THE OPENING AND CLOSING OF AUTOMATIC ELEVATOR DOOR, AND A DOOR COUPLER

[75] Inventor: Franz Mittermayr, Loich, Austria

[73] Assignee: Kone Corporation, Helsinki, Finland

[21] Appl. No.: 09/029,946

[22] PCT Filed: Sep. 13, 1996

[86] PCT No.: PCT/FI96/00486

§ 371 Date: Apr. 17, 1998

§ 102(e) Date: Apr. 17, 1998

[87] PCT Pub. No.: WO97/10168

PCT Pub. Date: Mar. 20, 1997

[30] Foreign Application Priority Data

Sep. 13, 1995 [FI] Finland ..... 954306

[51] Int. Cl.[6] ..... B66B 13/12

[52] U.S. Cl. ..... 187/319; 187/330

[58] Field of Search ..... 187/319, 330, 187/313, 325, 314; 49/116, 120

[56] References Cited

U.S. PATENT DOCUMENTS 1,876,438 9/1932 Werner ..... 187/330

FOREIGN PATENT DOCUMENTS 0 164581A1 12/1985 European Pat. Off. .
0 332841A1 9/1989 European Pat. Off. .
2 735614A1 2/1979 Germany .

*Primary Examiner*—Kenneth W. Noland
*Attorney, Agent, or Firm*—Birch, Stewart, Kolasch & Birch, LLP

[57] ABSTRACT

In the arrangement in the opening and closing of automatic elevator doors, the door coupler (20) is mounted on the car door so as to be movable in the direction of movement of the car door. The door coupler (20) is connected to a lever (21) whose first end is pivoted on the car door while its second end is pivoted on the door coupler. The power for the opening and closing of the doors is applied to the lever (21,71) via a point between its first end (21*a,* 71*a*) and second end (21*b,* 71*b*).

9 Claims, 4 Drawing Sheets

Figure 1:
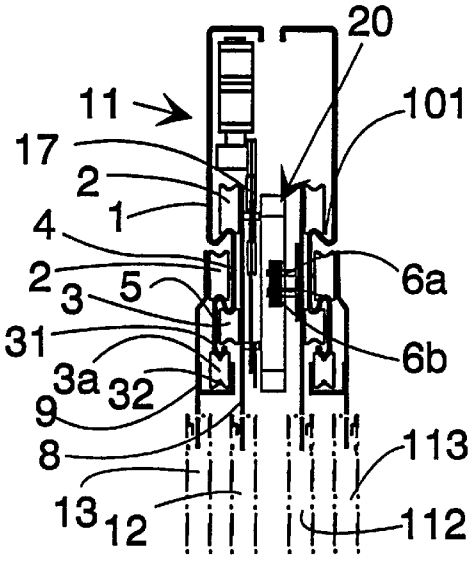

ARRANGEMENT IN THE OPENING AND CLOSING OF AUTOMATIC ELEVATOR DOOR, AND A DOOR COUPLER

This application is the national phase under 35 U.S.C. §371 of prior PCT International Application No., PCT/FI96/00486, which has an International filing date of Sep. 13, 1995, which designated the United States of America, the entire contents of which are hereby incorporated by reference.

The present invention relates to an arrangement in the opening and closing of elevator doors as defined in the preamble of claim 1 and to a door coupler as defined in the preamble of claim 5.

In elevators provided with automatic doors, the coupling between the car door and the landing door is generally implemented using a door coupler which is mounted on the car door and engages counterparts mounted on the landing door by means of its gripping elements. The door coupler and the counterparts are so fitted relative to each other that, when the elevator car is moving past the landing door, the counterparts on the landing door are passed between the gripping elements of the door coupler. When the car is at a landing and the car doors are moved, the door coupler is in engagement with the counterparts. In this way, the landing door moves together with the car door when the latter is moved by a power means connected to the car door. Often the gripping elements are metal vanes projecting from the door coupler towards the landing door and forming a kind of a vertical slot which is open towards the landing door. The counterparts used often consist of rollers mounted on the landing door and projecting from the door towards the elevator shaft, the axle of the rollers being mounted in a position perpendicular to the plane of the door.

When an elevator car stops at a landing, usually the elevator car and the landing devices are not exactly aligned with each other, but either the location or position, or both, of the elevator car differs at least somewhat from the ideal location or position with respect to the equipment at the landing. For this reason, there are problems with the coupling between the car door and landing door, because inadequate alignment between the door coupler and the counterparts may lead to a host of various problems. If the door coupler is not properly aligned with the rollers on the landing door, this may result in noise, reliability problems, interruption of door operation, obstruction of emergency opening of the door, incomplete opening or closing movement of the door, etc.

In order to overcome the aforesaid problems relating to the opening and closing of elevator doors and the coupling between the car door and landing door, an arrangement in the opening and closing of automatic elevator doors and a door coupler are presented as an invention. The arrangement of the invention is characterized by what is presented in the characterization part of claim 1. The door coupler of the invention is characterized by what is presented in the other claims.

The advantages provided by the invention include the following:

- The invention ensures a reliable coupling between the car door and landing door and complete closing of the doors even if the doors are not aligned with each other.
- The drawbacks of defective or unsuccessful coupling, such as clatter and noise, interruption of door operation, the doors getting stuck, etc. are avoided.
- When either the landing door or the car door has already been completely closed, this does not stop the closing movement of the other door which may not yet have been closed.

- Both the car door and the landing door can be opened and closed without hindering each other even if one of them should reach the extremity its opening or closing movement before the other one has reached its extreme position.
- The door coupler of the invention can provide a large clearance between the door coupler vanes for the rollers on the landing door, so the car door and the landing door need not be very accurately aligned with each other.

Figure 2:
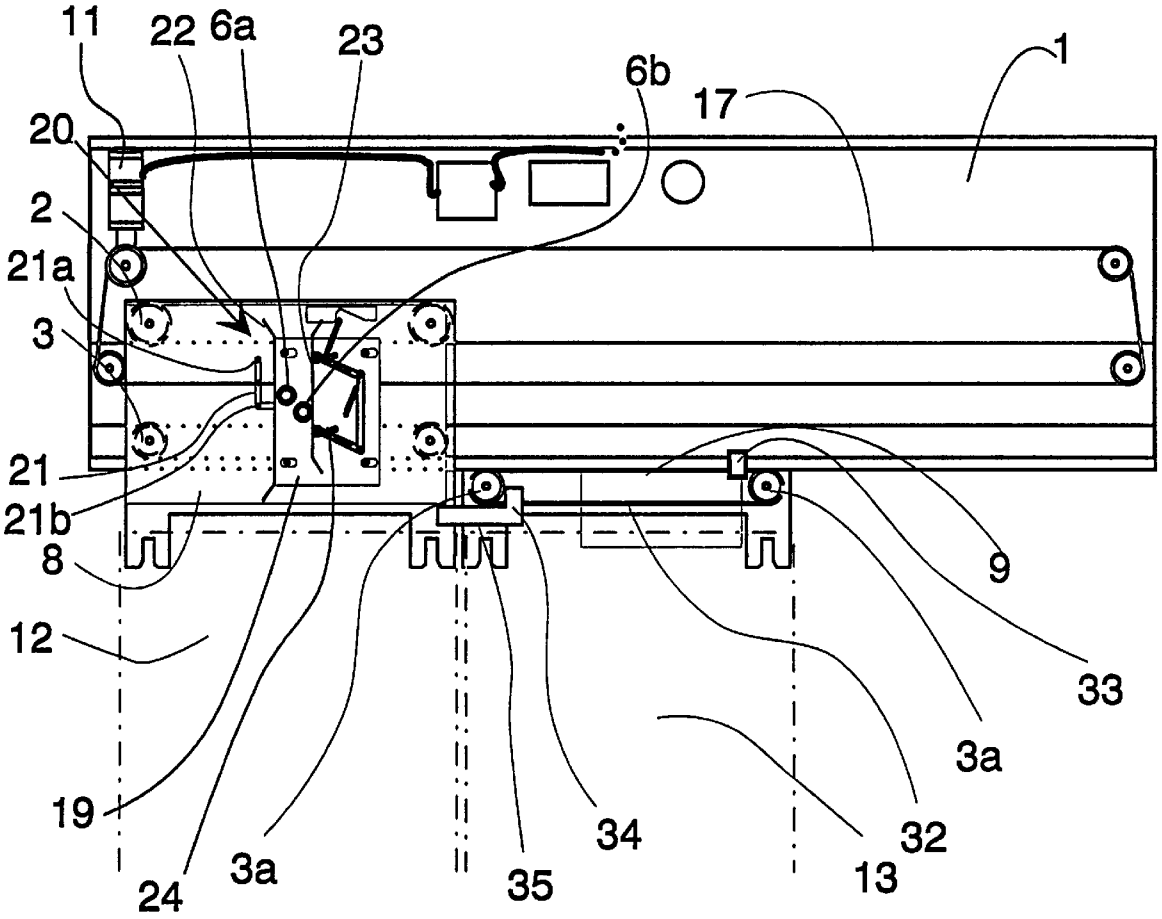
Figure 3:
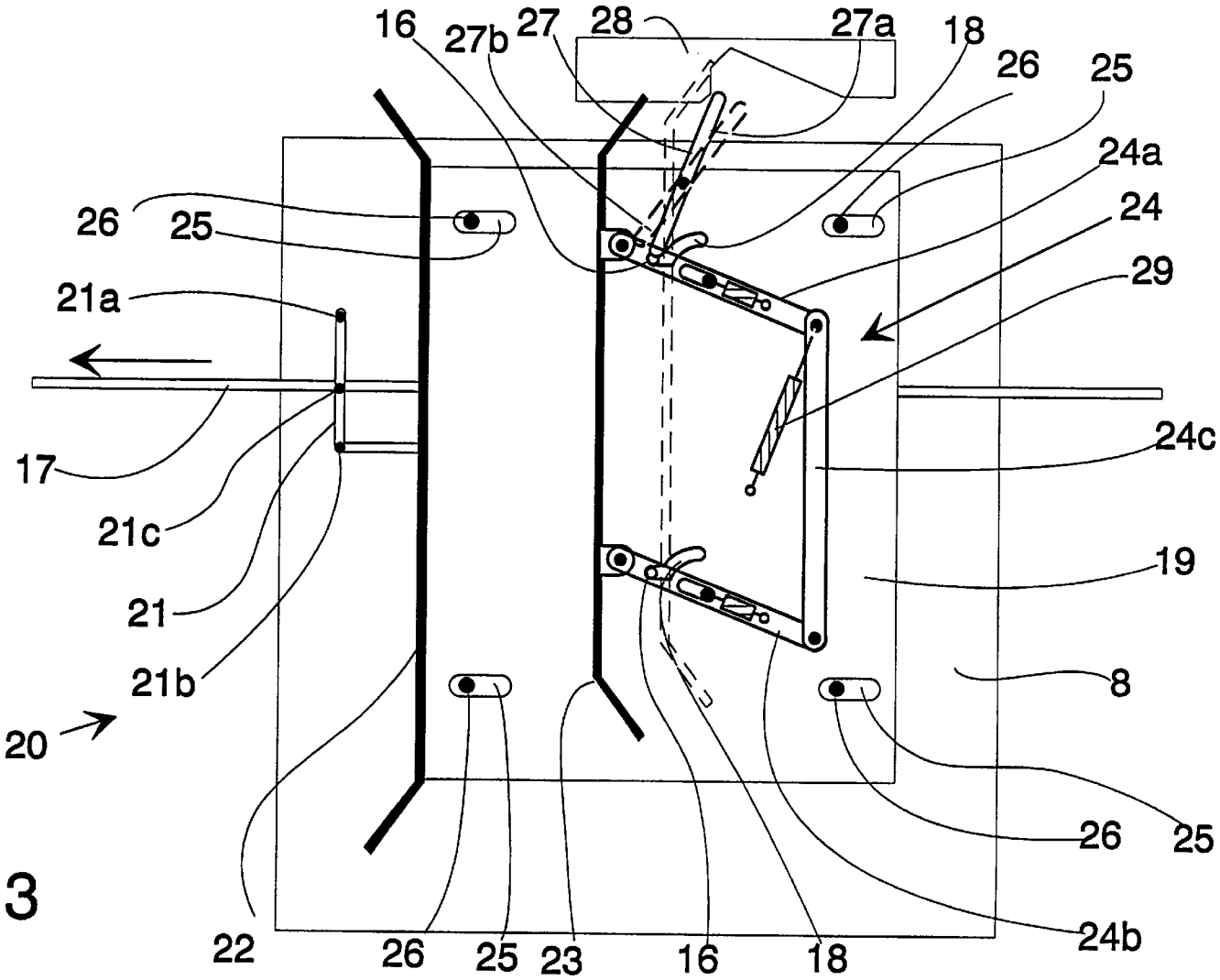
Figure 4:
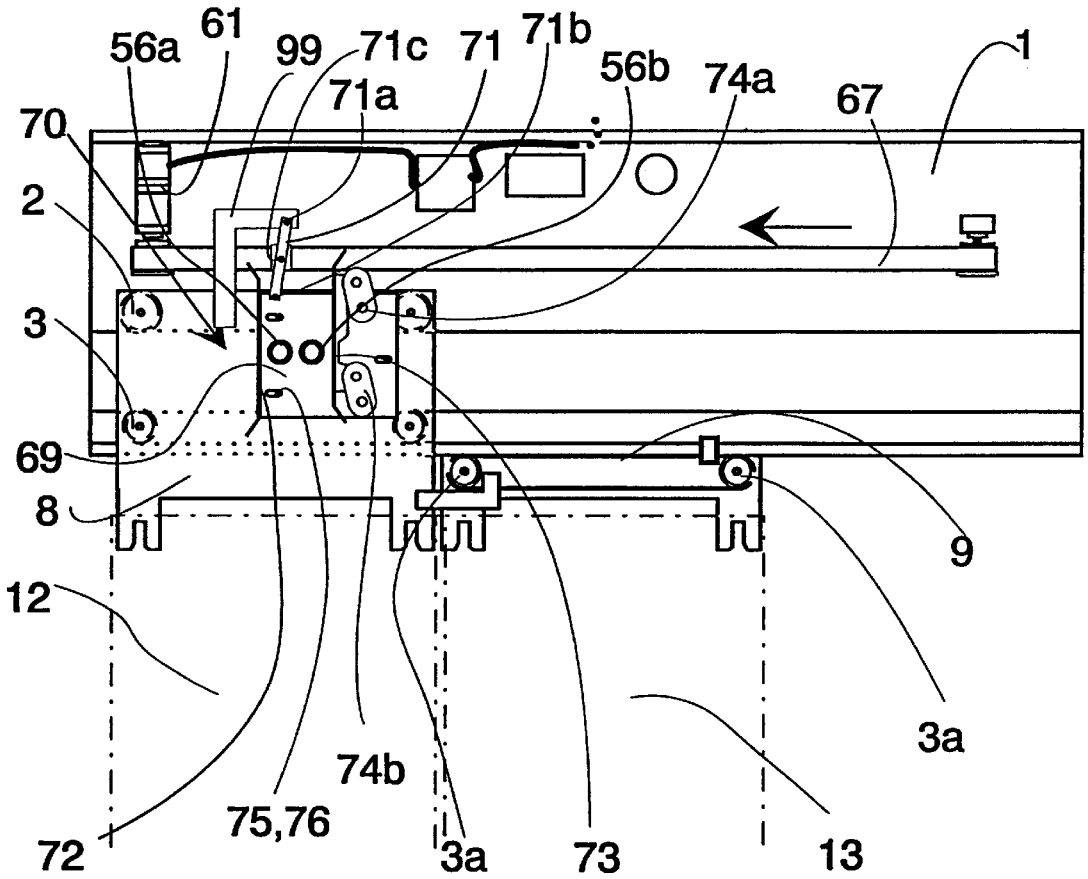
Figures 5, 6, 7:
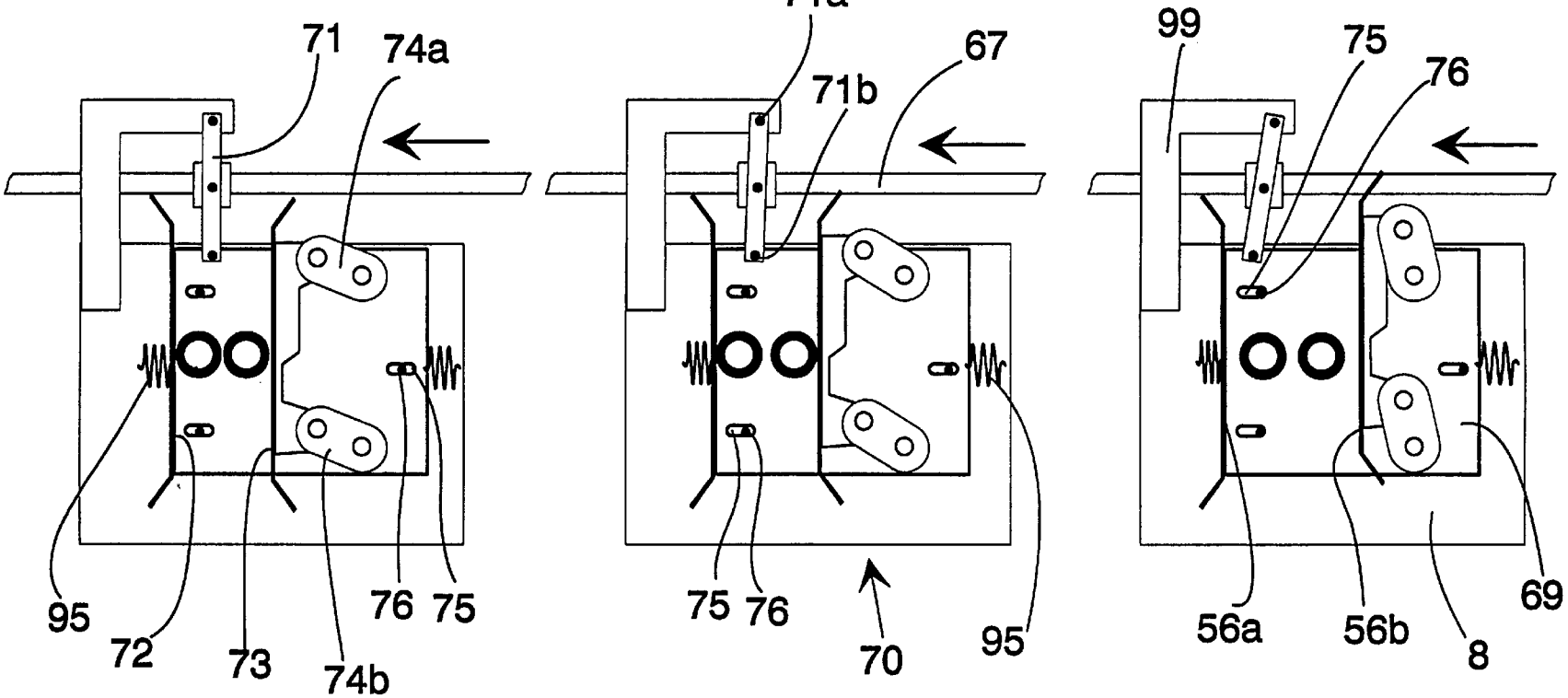

In the following, the invention is described by the aid of a few examples of its preferred embodiments by referring to the attached drawings, in which FIG. 1 presents a car door and a landing door applying the invention, together with the supporting beam, seen from the direction of the end of the beam, FIG. 2 presents a car door applying the invention, together with its supporting beam, as seen from the direction of the landing, FIG. 3 presents a door coupler as provided by the invention, FIG. 4 presents the supporting beam system of another car door applying the invention as seen from the direction of the landing, FIGS. 5–7 present another door coupler as provided by the invention, depicted at different stages of the closing movement of the door.

FIGS. 1 and 2 present the overhead supporting beam of a car door applying the invention and the suspension of the door panels 12 and 13 on the overhead supporting beam. FIG. 1 shows the structure as seen from the direction of the end of the beam and FIG. 2 shows it from the direction of the landing, i.e. from the side of the fast door panel 12. FIG. 1 shows the cross-sectional form of the overhead supporting beam as well as the locations of the rollers 2 supporting the door panels and those of their counter rollers 3,3*a* relative to the supporting beam 1. FIG. 1 also shows the landing door 112,113 together with its supporting structure 101. The door coupler 20 is presented in greater detail in FIG. 3. Formed in the supporting beam 1 are roller races 4,5. Suspended on the upper roller race 4 is the fast door panel 12 of a telescoping door while the slow door panel 13 is suspended on the lower roller race 5. The counter rollers 3*a* attached to the supporting plate 9 of the slow door panel 13 are provided with rope grooves 31, through which the synchronizing rope 32 is passed. The synchronizing rope 32 forms a loop which at one point 33 is immovably fixed to the roller race 5 or otherwise immovably fixed relative to the beam 1 and at another point 34 to a fixture 35 on the fast door panel 12. These points 33,34 move in opposite directions in relation to the slow plate 9 when the door is opened or closed because they are attached to parts of the loop that move in opposite directions. Therefore, the fast door panel 12 with its supporting plate 8 and the slow door panel 13 with its supporting plate 9 move in synchronism aside from the door opening and back to close the door opening. A driving gear 11 drives a rope 17, which further moves the door panels. The door operating mechanism may also consist of a different system than a simple combination of a driving gear, rope pulleys and a rope driven by a driving gear. The rope 17 is attached to a lever 21 at a point between its first end 21*a* and second end 21*b*, preferably at the middle of the lever. The rope 17 is preferably attached to the lever 21 with a turnable joint 21*c*. The first end 21*a* of the lever is pivoted on the supporting plate 8 of door panel 12 while its other end 21*b* is pivoted on the base plate 19 of the door coupler 20. Fixedly attached to the base plate 19 is a first vane 22. The door coupler 20 is movable within certain limits in the direction of the opening and closing movement of the car door. The motion of the door coupler 20 has been achieved by providing horizontal elongated holes 25 in the base plate and guide pins 26 attached to the supporting plate 8 and extending into said holes. The movement of the door coupler on the supporting plate is limited by the play of the guide pins 26 in the holes. A second door coupler vane 23 is mounted on the base plate via a linkage 24. The vanes 23 and 22 form a gap between them which is opened and closed by the agency of the linkage 24. The linkage comprises an upper link 24*a* and a lower link 24*b* holding the second vane 23 and a connecting rod 24*c* connecting the upper and lower links. The connecting rod 24*c* acts as a synchronizer of the movements of the vane holding links 24*a*,24*b*. When the gap is closed, the door coupler vanes 22,23 press the landing door rollers 6*a*,6*b* between them, and the door coupler is thus coupled with the landing door.

When the gap is opened, the vanes move farther apart and release the rollers 6*a*,6*b*. The lower end 27*b* of an arresting lever 27 pivoted on the door coupler prevents the gap from being opened too soon. It is only after the closing movement of the door has been nearly completed that the arresting lever is turned by the action of a stop block 28 engaging the upper end 27*a* of the lever. The stop block may be e.g. a part in the locking mechanism of the door. Upon meeting the stop block, the blocking lever turns, thereby releasing the linkage 24 connecting the second vane 23 to the base plate, causing the second vane 23 to move farther apart from the first vane 22. In FIG. 3, the blocking lever 24 is depicted with broken lines in its position after the turning, and similarly the second vane 23 is depicted with broken lines in its farther position. The withdrawing motion of the second vane 23 is effected by means of a draw-spring 29 and utilizing the very last stage of the closing movement of the door. At the end of the closing movement, roller 6*b*, which is immovable in relation to the landing door, stops the second vane 23 as the landing door stops at the end of its closing movement. The first vane continues moving in the direction of the closing movement. In FIG. 3, the direction of the closing movement is indicated by an arrow above the rope 17. When the doors have been closed, the gap between the vanes 22,23 of the door coupler 20 has opened so that, as the elevator is moving, the rollers 6*a*,6*b* acting as counterparts attached to the landing door are allowed to pass unobstructed between the vanes 22,23. When the elevator has stopped at a landing, the rollers 6*a*,6*b* remain pressed between the vanes 22,23 when the door is being opened or closed. As the rollers 6*a*,6*b* are pressed between the vanes 22,23, they move horizontally towards each other and release the lock of the landing door. The vanes 22,23 are kept pressed against the rollers 6*a*,6*b* throughout the opening and closing movement of the door. In a preferred case, to ensure that the vanes will remain pressed against the rollers, the door coupler is provided with a blocking device or the like which only permits the vanes to move apart from the rollers when the doors are in their closed position. The arresting lever 27, a shaped hole 18 in the base plate 19 and a pin 16 extending from the linkage 24 to the shaped hole 18 form the essential parts of the blocking device, whose operation is controlled by the motion of the shape of the stop block 28 relative to the arresting lever. Using the blocking device or otherwise, an arrangement can be provided such that after the door movement has caused the vanes to move apart through a preset distance, preferably a few millimeters, a triggering action occurs in the blocking device, which only then allows the draw-spring 29 to pull the door coupler vanes apart. In this way, a remarkably large clearance between the rollers and the vanes is achieved.

FIG. 4 presents another supporting beam solution for a car door applying the invention, together with associated equipment, as seen from the direction of the landing. Suspended on the overhead supporting beam 1 of the car door are door panels 12 and 13. The operation of the door coupler 70 presented in the solution in FIG. 4 is illustrated by FIGS. 5–7, in which the door coupler is depicted in different stages of the closing movement of the door. FIG. 5 shows a situation where the door is open and the door coupler 70 is holding the rollers 56*a*,56*b* in its grip. FIG. 6 presents a situation at the end of the closing movement of the door, when the door coupler vanes have started to move apart and is releasing the rollers 56*a*,56*b* from their grip. In FIG. 6, the door is completely closed and the door coupler 70 has completely released the rollers 56*a*,56*b*.

The supporting beam 1 is provided with roller races for the rollers 2,3,3*a*. The fast door panel 12 is suspended on the upper roller race and the slow door panel 13 is suspended on the lower roller race. Attached to the supporting plate 9 of the slow door panel 13 are counter rollers 3*a*. The driving gear 61 drives a belt 67, which in turn moves the door panels. The belt 67 is attached to a lever 71 at a point between the first end 71*a* and the second end 71*b* of the lever, preferably at the middle of the lever. The belt 67 is attached to the lever 71 with a turnable joint 71*c*. The first end 71*a* of the lever is pivoted on an ear 99 attached to the supporting plate 8 of door panel 12 while its other end 71*b* is pivoted on the base plate 69 of the door coupler 70. Fixedly attached to the base plate 69 is a first vane 72. The door coupler 70 is movable within certain limits in the direction of the opening and closing movement of the car door. The motion of the door coupler 70 is achieved by providing horizontal elongated holes 75 in the base plate 69 and guide pins 76 attached to the supporting plate 8 and extending into said holes 75. The movement of the door coupler on the supporting plate is limited by the play of the guide pins 76 in the holes 75. A second door coupler vane 73 is movably mounted on the base plate 69 via a links 74*a*,74*b*. The vanes 73 and 72 form a gap between them which is opened and closed by the operation of the vane holding links 74*a*,74*b*. When the gap is closed, the door coupler vanes 72,73 press the landing door rollers 56*a*,56*b* between them, and the door coupler 70 is thus coupled with the landing door. When the gap is opened, the vanes move farther apart and release the rollers 56*a*,56*b*. The door coupler is provided with means to prevent the vanes from moving apart too soon. Only when the closing movement of the door has been nearly completed are the door coupler vanes allowed to move apart. At the end of the closing movement, roller 56*b*, which is immovable in relation to the landing door, stops the second vane 73 as the landing door stops at the end of its closing movement. The first vane continues moving in the direction of the closing movement. The direction of the closing movement is indicated by an arrow above the belt 67. When the doors have been closed, the gap between the vanes 72,73 of the door coupler 70 has opened so that, as the elevator is moving, the rollers 56*a*,56*b* acting as counterparts attached to the landing door, are allowed to pass unobstructed between the vanes 72,73. When the elevator has stopped at a landing, the rollers 56*a*,56*b* remain pressed between the vanes 72,73 when the door is being opened or closed. As the rollers 56*a*,56*b* are pressed between the vanes 72,73, they move horizontally towards each other and release the lock of the landing door. To ensure that the vanes will remain pressed against the rollers, the door coupler is provided with a blocking device which only permits the vanes to move apart from the rollers when the doors are in their closed position. The blocking device may differ from the one presented in FIG. 3. In conjunction with the blocking device there is preferably an actuator, such as a spring, a weight or the like, which moves the vanes 56*a*,56*b* completely apart at the end of the closing movement of the door. The door coupler can be centered in a given location on the supporting plate 8 by using springs 95, leaving a preset correction margin at each end of the path of the door for the correction of any disalignment between the car door and the landing door. The correction margin equals half the play determined by the holes 75 and pins 76. The springs 95 preferably consist of a pair of draw-springs attached to the supporting plate 8 of the car door, the door coupler being mounted between the springs. The dynamics of the movements between the landing doors and the car door as well as the operation of the vanes can be adjusted by making use of the friction between the pins and the holes.

It is obvious to a person skilled in the art that different embodiments of the invention are not restricted to the examples described above, but that they may instead be varied in the scope of the claims presented below. For instance, the door coupler can be mounted in a different place on the car door than on the supporting plate, although it is customary for the door coupler to be mounted either on the door panel or on the door panel supporting plate. It is further obvious to the person skilled in the art that, instead of elongated holes, the door coupler may have slots or other structures to permit a play of the door coupler relative to the car door.

I claim:

1. Arrangement in the opening and closing of automatic elevator doors, characterized in that the car door and the landing door are so coupled that they are only allowed a limited motion relative to each other in the direction of movement of the doors, and that the power effecting the opening and closing movement of the doors is applied to the doors via a transmission element (21,71) in which a point (21*a*,71*a*) transmitting the power to the car door is so connected as to move along with the movement of the car door and a point (21*b*,71*b*) transmitting the power to the landing door is so connected as to move along with the movement of the landing door.

2. Arrangement according to claim 1, characterized in that the transmission element (21,71) is a lever and that the door coupler (20,70) is mounted on the car door so as to be movable in the direction of movement of the car door, and that the door coupler (20,70) is connected to the lever (21,71), whose first end is pivoted on the car door while its second end is pivoted on the door coupler, and that the power produced by a driving gear (11, 61) for the opening and closing of the doors is applied to the lever (21,71) via a point between its first end (21*a*,71*a*) and second end (21*b*,71*b*).

3. Arrangement according to claim 2, characterized in that the door coupler (20,70) is mounted on the supporting plate (8) of the car door.

4. Arrangement according to claim 2, characterized in that the power produced by the driving gear (11,61) is transmitted by means of a flexible element, such as a rope (17) or a belt (67).

5. Arrangement according to claim 4, characterized in that the flexible element (17,67) transmitting the power is connected to the lever (21,71) via a point at the middle of the lever, preferably using a turnable joint (21*c*,71*c*).

6. Door coupler (20,70) mounted on the car door and provided with gripping elements (22,23,72,73) designed to grip a counter element (6*a*,6*b*) mounted on the landing door in situations where the elevator has stopped at a landing, characterized in that the door coupler (20,70) is so mounted on the car door as to be movable in the direction of movement of the car door, and that the door coupler (20,70) comprises a lever turnably attached by its second end (21*b*,71*b*) to the door coupler and by its first end (21*a*,71*a*) to the car door, said lever being connected at a point between its first end (21*a*,71*a*) and second end (21*b*,71*b*) to a driving gear operating the door.

7. Door coupler according to claim 6, characterized in that the door coupler (20,70) is mounted on the supporting plate (8) of the car door, preferably so that it is supported by guide pieces (26,76) immovable relative to the door supporting plate (8), said guide pieces preferably consisting of pins fixed to the supporting plate and extending into elongated holes (25,75) or slots in the door coupler.

8. Door coupler according to claim 6, characterized in that the play of the door coupler in relation to the car door is determined by the holes (25,75) or slots and the pins (26,126).

9. Door coupler according to claim 6, characterized in that it is provided with springs (95) to set the door coupler (20,70) in a given position with respect to the car door.

* * * * *